United States Patent [19]

Maly et al.

[11] Patent Number: 4,634,508

[45] Date of Patent: Jan. 6, 1987

[54] PROCESS FOR COATING SHEARED EDGES OF METAL CAN LIDS

[75] Inventors: Zdenek Maly; Erich Höfling, both of Kreuzlingen, Switzerland

[73] Assignee: Swiss Aluminium Ltd., Chippis, Switzerland

[21] Appl. No.: 742,902

[22] Filed: Jun. 10, 1985

[30] Foreign Application Priority Data

Jun. 18, 1984 [CH] Switzerland ..... 2946/84

[51] Int. Cl.[4] ..... C25D 13/04; C25D 13/06; C25D 13/10; C25D 13/12

[52] U.S. Cl. ..... 204/181.6; 204/181.7

[58] Field of Search ..... 204/181.6, 181.7, 300 EC

[56] References Cited

U.S. PATENT DOCUMENTS 3,759,810 9/1973 Laudauer et al. ..... 204/300 EC 4,005,000 1/1977 Kraska ..... 204/300 EC

*Primary Examiner*—Howard S. Williams

*Attorney, Agent, or Firm*—Bachman & LaPointe

[57] ABSTRACT

The invention relates to a process for coating bare, sheared edges of the pouring or drinking outlets stamped out in metal lids for beverage cans. In the process, modified lacquers are deposited electrophoretically on the bare, non-insulated sheared regions of the lid.

7 Claims, 3 Drawing Figures

PROCESS FOR COATING SHEARED EDGES OF METAL CAN LIDS

BACKGROUND OF THE INVENTION

The present invention relates to a process for coating the sheared edges of pouring or drinking outlets stamped out in the metal lids for beverage cans.

Metal lids for beverage cans, usually made of steel, aluminum or an aluminum alloy, have to be fitted with a facility by means of which an outlet can be made in the lid to allow the contents to be poured out. The best known facility of this kind is the so called ring-pull-system which provides a notch in the lid surface to delineate the predestined opening. This notched region is then torn apart when opening the can. In newly developed systems the outlet for pouring or drinking is first stamped out of the lacquer coated sheet then closed off by sealing a pull-off tab over the said outlet. The edge around the opening in the lid remains unprotected which, especially in the case of lids made of steel sheet, in unfavorable for two reasons. Firstly, the bare metal is exposed to chemical attack by the contents of the can. Secondly, the contents can take up metal by dissolving the same in it, which is undesireable, especially in the case of heavy metals.

Attempts have therefore been made to protect the bare edge of the opening in the lid in order to prevent corrosive attack of the lid and contamination of the contents by dissolved metal.

It has, however, been found particularly difficult to cover over the burrs of metal at the edge which occur increasingly with increasing wear of the stamping tool. With normal spraying methods it is not possible to achieve full coverage of the edge with a fluid lacquer, this because of the particular characteristics of an edge. Full coverage is not even possible with repeated application of the lacquer.

It has also been attempted to protect the edges of these openings with a thick layer of a PVC plastisol. Use of this method on an industrial scale, however, is not feasible, partly because of the large material consumption involved and partly because of the risk of softener in the plastisol migrating into the contents of the can.

The object of the present invention is therefore to develop a process for coating the sheared edges of openings for pouring or drinking stamped out of metal lids for beverage cans, such that the said process permits complete coverage of the sheared edges, especially the burrs thereon, and employs for that purpose a coating material that is in conformity with foodstuffs. The pore test (WACO) should then register a limiting current of, at most, 0.4 mA at a voltage of 6 V in a 1 wt-% NaCl solution. Further, the process should feature short coating and drying times, a minimum treatment rate of 60 lids per minute, and be realisable with minimum material consumption in a unit at reasonable cost.

SUMMARY OF THE INVENTION

The foregoing object is achieved by way of the present invention in that modified lacquers are deposited electrophoretically on the bare, non-insulated parts of the lid.

An electrophoretic process for depositing lacquer coatings are such that particles of lacquer are deposited on a metal surface from a colloidal solution or dispersion under the application of direct electric current, similar to the electrodeposition of metals. An insulating layer of lacquer forms in the course of the electrophoretic process. The deposition of the lacquer takes place only until the whole of the metallic surface of the workpiece is covered with an electrically insulating layer. No deposition can take place on surfaces which are already lacquered before the start of the electrophoretic process.

The deposition process can be performed anodically (anaphoresis) or cathodically (cataphoresis), depending on the voltage applied to the workpiece to be coated. The mode of deposition is determined by the chemical composition of the lacquer and its incorporation in the aqueous colloidal solution or dispersion. A description of the chemical events taking place during electrophoresis is given in the proceedings of the American Chemical Society Symposium in Los Angeles, Mar. 31–Apr. 1, 1973, concerning "Electrodeposition of Coatings", published by G. E. Brewer, Washington, D.C., 1973.

Can lids are made from steel or aluminum or aluminum alloy strip which is lacquer coated on both sides. Electrophoretic deposition of lacquer is therefore possible only at the bare metal edges of the openings for pouring or drinking.

According to a first version of the invention lacquers of the anodic type, preferably such made up of acrylic polymers and/or acrylic copolymers, are employed. These acrylic resins are dissolved or dispersed in water at a pH between 8 and 10 with the aid of at least one amine. The dispersed or colloidally dissolved lacquer is then deposited anaphoretically, in which process the workpiece, that is the lid for the beverage can, forms the anode.

In a second version of the process according to the invention lacquers of the cathodic type, in particular epoxy esthers, are dissolved or dispersed in water at a pH between 3.5 and 4.5 with the aid of an organic acid. Preferred organic acids here are acetic acid or lactic acid. The lacquer in the colloidal solution of dispersion is then deposited cataphoretically, in which case the workpiece froms the cathode.

Trials have shown that if the lacquers normally used in the electrophoetic process are employed for this purpose then during the baking i.e. stoving operation the layer deposited on the metal surface becomes very low in viscosity and runs off the burrs of metal. The lacquers must therefore be modified. Preferably a thixotropizing agent and/or a suitable pigment is/are therefore added to the lacquers, as a result of which this loss of lacquer at the edges is countered. Particularly suitable thixotropizing agents are e.g. large surface area silicon oxide and/or Bentonite. Pigment particles of proven value are for example mica powder, titanium dioxide and/or calcium carbonate.

The colloidal lacquer solution and dispersion usefully have a total solids content of 5–15 wt-%, preferably 8–12 wt-%, and exhibit an electrical conductivity of 400–1200 μS (micro-Siemens).

A rectified voltage of preferably 100–300 V is applied across the electrodes. The thickness of the layer deposited depends on the magnitude of this voltage and on the electrical conductivity of the lacquer layer; for this reason these have to be set in accordance with each other, in order that a complete and uniform coating is obtained.

The lids treated with the electrophoretic process according to the invention are immersed in the electrophoretic bath preferably for 0.5–5 seconds, in particular for 1–3 seconds. In a continuous process this permits a throughput of at least 60 lids per minute.

The optimum temperature for the electrophoretic bath lies in the range 20°–30° C., in particular 22°–25° C. i.e. at about room temperature or just above.

With the process according to the invention the main requirements are satisfied, that is, complete coating of the sheared edges and the use of coating materials in conformity with foodstuffs. Currents of 0–0.2 mA were measured using the pore test (WACO) at a voltage of 6 V. Also with respects to the economic aspects of the process the results obtained on an industrial scale met and even surpassed the expected results.

BRIEF DESCRIPTION OF THE DRAWINGS

The invention is explained in greater detail in the following description of exemplified embodiments and with the aid of the schematic drawings wherein, FIG. 1 Illustrates the transition region between a hot-sealed tab and the bare, sheared edge in a can lid.

DETAILED DESCRIPTION

Figure 1:
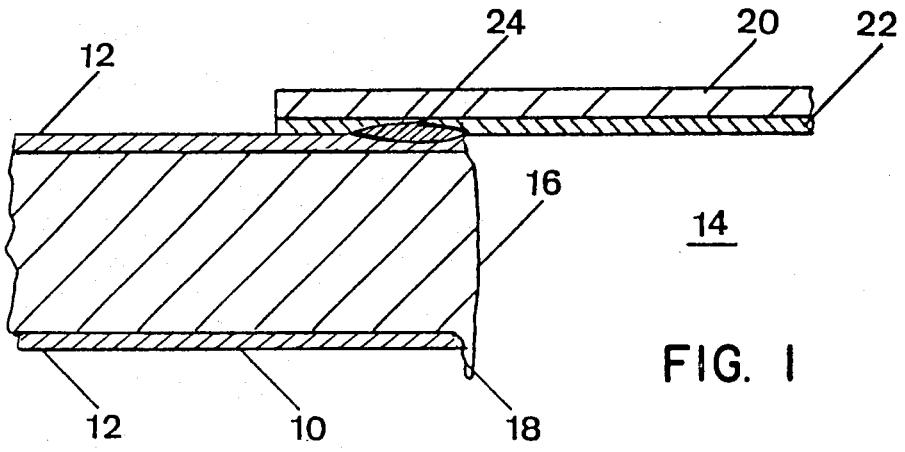

The lid stock material 10 shown in FIG. 1, usually made of steel sheet for the packaging industries, is protected on both sides by a layer of lacquer 12. On stamping out the opening 14 for pouring or drinking a bare, sheared edge 16 with a burr 18 in the direction of stamping has been produced. The said opening 14 has been closed over by a hot sealed tab which is made of thin strip 20 of an aluminum can stock alloy and on the side facing the lid a conventional thermally sealable layer 22 on the side facing the lid. The tab has been hot sealed to the lid with a seam 24 which seals the opening but can be torn open at will. FIG. 1 represents the current state of the art.

Figure 2:
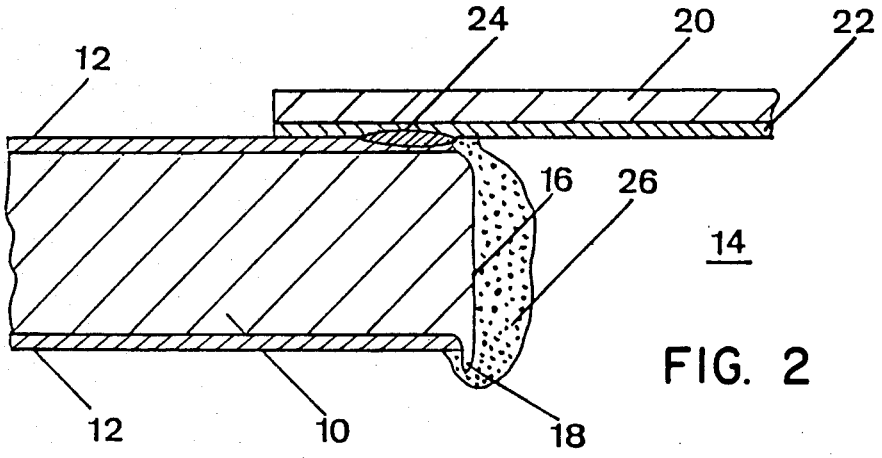
FIG. 2 Illustrates the transition region between a hot-sealed tab and the protected, sheared edge in a can lid.

Shown in FIG. 2 is a layer 26 which has been deposited according to the process of the invention and protects the previously bare region of the sheared edge 16 from corrosive attack and, at the same time, prevents the contents from becoming contaminated with dissolved metal.

Figure 3:
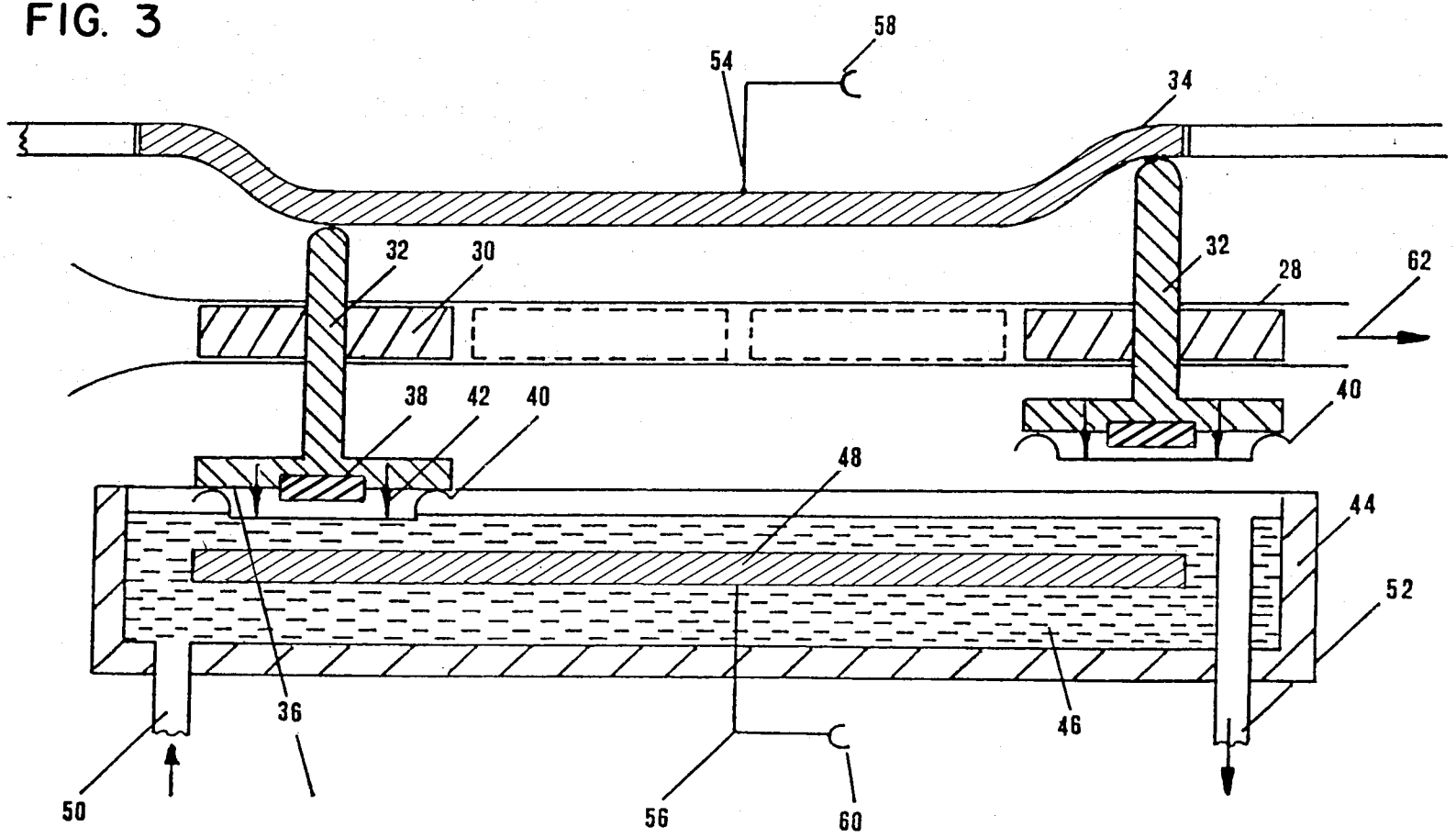
FIG. 3 Is a unit for electrophoretic lacquering of the sheared edges of pouring and drinking holes stamped out in lids for beverage cans.

The unit shown in FIG. 3 for electrophoretic lacquering of the sheared edges of pouring and drinking openings lids for beverage cans operates in a continuous manner. Riding on a guiderail 28 are sliding blocks 30 which can be pushed along the rail 28 without twisting out of position. These blocks 30 are fitted with lid holders 32 which can be moved vertically and are pressed by the force of a opening such that the upper part of their vertical shaft is pressed against a contact rail 34 acting as an electrode. In the region of the electrophoretic bath the contact rail curves downwards as a result of which the lid holders 32 moving horizontally are pushed downwards and the springs, not shown here, are tensed.

Embedded at the center of the flat, horizontal sole 36 of lid holder 32 is a permanent magnet 38 which pulls the steel lid 40 towards it. Further, contact pins 42 make electrical contact with the steel lid 40. The electric current is conducted via the contact rail 34, lid holder 32 and contact pins 42 to the lid 40.

Tank 44 contains a colloidal solution which functions as an electrophoretic bath 46; immersed in this solution is a horizontal electrode 48. The tank 44 is fitted with a feed pipe 50 for supplying the colloidal solution to the tank and also an overflow pipe 52 which regulates the depth of the bath.

The direct electric current is supplied to the electrodes 34, 48 from poles 58, 60 via conductors 54, 56 resp. The current supply is designed such that electrode 48 can be used as cathode or anode, likewise the contact rail 34.

During the operation of the unit the lid holders 32, supported by the blocks 30, are slid along the guiderail 28 in the direction shown by the arrow. The contact rail 34 causes the lid holders 32 to be moved down in the region of the bath 46, and this such that the steel lids 40 just touch the surface of the bath. The steel lids 40 are then moved along the surface of the electrophoretic bath until the contact rail 34 allows them to move upwards again at the other end of the bath. After electrophoretic coating, the steel lids 40 are passed into rinsing and drying zones, not shown here, then stroked off the holders 32.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for coating the sheared edges of openings for pouring or drinking stamped out in metal lids for beverage cans wherein said sheared edges of openings are characterized by burrs, comprising applying a rectified voltage of 100–300 V for electrophoretically depositing modified lacquers containing a thixotropizing agent selected from the group consisting of large surface area silicon oxide, Bentonite and mixtures thereof and pigments selected from the group consisting of mica powder, titanium dioxide, calcium carbonate and mixtures thereof on the bare non-insulated regions of the sheared edges of the lids including the burrs wherein said modified lacquer has a solids content of 8–12 wt.%.

2. A process according to claim 1 wherein anodic lacquers selected from the group consisting of acrylic polymers, acrylic copolymers and mixtures thereof are colloidally dissolved in water at a pH of 8–10 with the aid of at least one amine and then deposited anaphoretically.

3. A process according to claim 1 wherein cathodic lacquers selected from the group consisting of epoxy esters are colloidally dissolved in water at a pH of 3.5–4.5 with the aid of an organic acid selected from the group consisting of acetic acid, lactic acid and mixtures thereof and then deposited cataphoretically.

4. A process according to claim 1 wherein the lids are immersed in an electrophoretic bath for 0.5–5 seconds.

5. A process according to claim 4 wherein the temperature of the electrophoretic bath is between 20°–30° C.

6. A process according to claim 4 wherein the temperature of the electrophoretic bath is between 22°–25° C.

7. A process according to claim 1 wherein the lids are immersed in an electrophoretic bath for 1–3 seconds.

* * * * *